US006619945B1

(12) United States Patent
Sims

(10) Patent No.: US 6,619,945 B1
(45) **Date of Patent: *Sep. 16, 2003**

(54) APPARATUS FOR FORMING STRUCTURAL BLOCKS FROM COMPACTIBLE MATERIALS

(76) Inventor: James O. Sims, 908 Brooks St. SE., Decatur, AL (US) 35602

( * ) Notice: Subject to any disclaimer, the term of this patent is extended or adjusted under 35 U.S.C. 154(b) by 190 days.

This patent is subject to a terminal disclaimer.

(21) Appl. No.: 09/653,566

(22) Filed: Aug. 31, 2000

(51) Int. Cl.[7] ..... B28B 3/06

(52) U.S. Cl. ..... 425/219; 425/352; 425/260; 425/448

(58) Field of Search ..... 425/219, 260, 425/448, 352, 422, 351

(56) References Cited

U.S. PATENT DOCUMENTS 3,953,187 A * 4/1976 James ..... 65/161
4,559,004 A * 12/1985 Augier ..... 425/261
4,569,649 A 2/1986 Gross ..... 425/344
5,247,870 A * 9/1993 Brasca et al. ..... 60/560
5,807,591 A * 9/1998 Aaseth et al. ..... 425/186
5,851,567 A * 12/1998 Proni ..... 425/346
6,012,287 A * 1/2000 Sims ..... 60/560

* cited by examiner

*Primary Examiner*—Robert Davis
*Assistant Examiner*—Thu Khanh T. Nguyen
(74) *Attorney, Agent, or Firm*—Joseph H. Beumer

(57) ABSTRACT

A machine for making building blocks from compactible materials such as earth, in a rapid and facile manner. A mold is provided in which the blocks of desired configuration, typically rectangular, are formed. A hydraulic ram, assisted by a pressure intensifier, is utilized to exert tremendously high pressures on the compactible material in the mold so that the particles of the materials are substantially bonded together to produce a solid block.

11 Claims, 14 Drawing Sheets

APPARATUS FOR FORMING STRUCTURAL BLOCKS FROM COMPACTIBLE MATERIALS

BACKGROUND OF THE INVENTION

1. Field of the Invention

The present invention relates to a machine for rapidly and efficiently forming building blocks from compactible material, and more particularly to such a machine which is provided with means for internally increasing the output pressure of the block forming hydraulic ram of the machine.

2. Description of the Prior Art

The use of earthen blocks as a building material has been known for centuries. Earth is available in unlimited supply at no expense, and it is available at the site of construction. Additionally, earth is non-toxic, non-allergenic, fireproof and soundproof. The high inherent insulating properties also enhance its desirability as a building material.

In somewhat recent years the earth at the building site has been fashioned into building blocks in a press and required compacting the earth material in a suitable machine having a hydraulic cylinder enclosing a ram piston. The ram exerts an output pressure against contained earth material to compact the earthen material into a block. In order to form the blocks at the construction site it is desirable to provide a machine which is portable and which is capable of providing sufficient pressure to form the earth into solid blocks. One such machine is disclosed in U.S. Pat. No. 4,569,649 issued to Robert Gross on Feb. 11, 1986.

It has been found that, although the machine identified above produces hydraulic pressures of 3,000 psi (210 kg./sq. cm) during the final stages of the block formation, such pressures do not compact the earth material sufficiently. One example, is the noticeable undesirable feature that the corners of the block tend to break away under slight pressure, thus leaving an incomplete ill formed block.

What is needed then is a machine which is relatively lightweight and portable and is transportable to the site and which should be capable of producing extremely high pressures which are capable of substantially "bonding" particles of the block forming material into a stable mass which will not "crumble" or otherwise fail under high external pressure.

SUMMARY OF THE INVENTION

The present invention provides a machine for forming building blocks from compactible materials, such as earth and other materials, as discussed hereinbelow. The machine overcomes the above noted deficiencies of previous machines by providing means for dramatically increasing the output pressures at which the block forming hydraulic ram exerts against compactible material held in a block forming mold of the machine.

To accomplish this pressure increase, a pressure intensifier hydraulic actuator is coupled into the ram cylinder for coaction therewith to dramatically increase the output pressure of the ram cylinder and thus provide a very high degree of bonding pressure of the particles forming the block.

It is, therefore, an object of the present invention to provide a machine for forming blocks from compactible material.

It is a further object of the invention to provide such a machine with means for increasing the output pressure of the block forming hydraulic ram which compacts the compactible materials into blocks of predetermined configuration.

These and other objects and advantages are accomplished by the present invention of a machine for making blocks from compactible material, such as earth etc. The machine comprises a block forming mold and a ram head. The ram head is capable of moving between a retracted position in which the head is removed from the mold, and the compactible material can fall through a bottom opening of a hopper which is moveable into and out of registry with an upper opening of the mold, and an advance position in which the head is moved into the mold and the compactible material is highly compressed to form a block. A hydraulic actuator cooperates with the ram cylinder to increase the output pressure of the ram.

BRIEF DESCRIPTION OF THE DRAWINGS

FIG. 4*a* illustrates the piston rod of a first fluid actuator being displaced from "home position" and into an axial bore of an end closure assembly which is common to the two fluid actuators which make up the pressure increasing assembly of the machine of the present invention.

DESCRIPTION OF THE PREFERRED EMBODIMENTS

Figure 1:
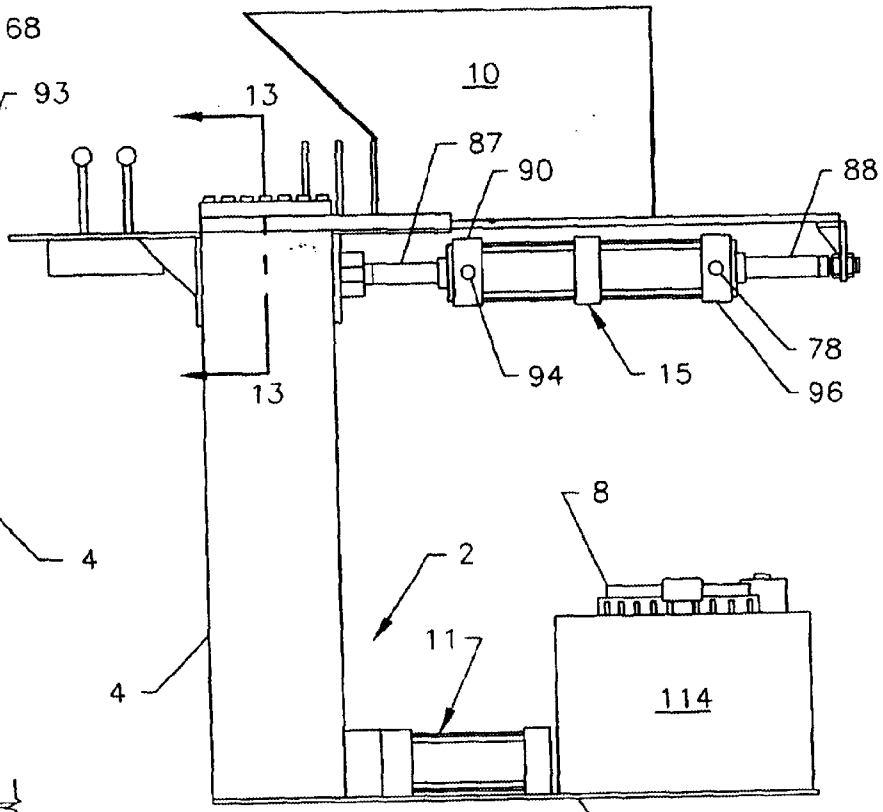
FIG. 1 is an elevational view of the block making machine of the present invention and illustrates a movable hopper for receiving the compactible materials therein.
Figure 12:
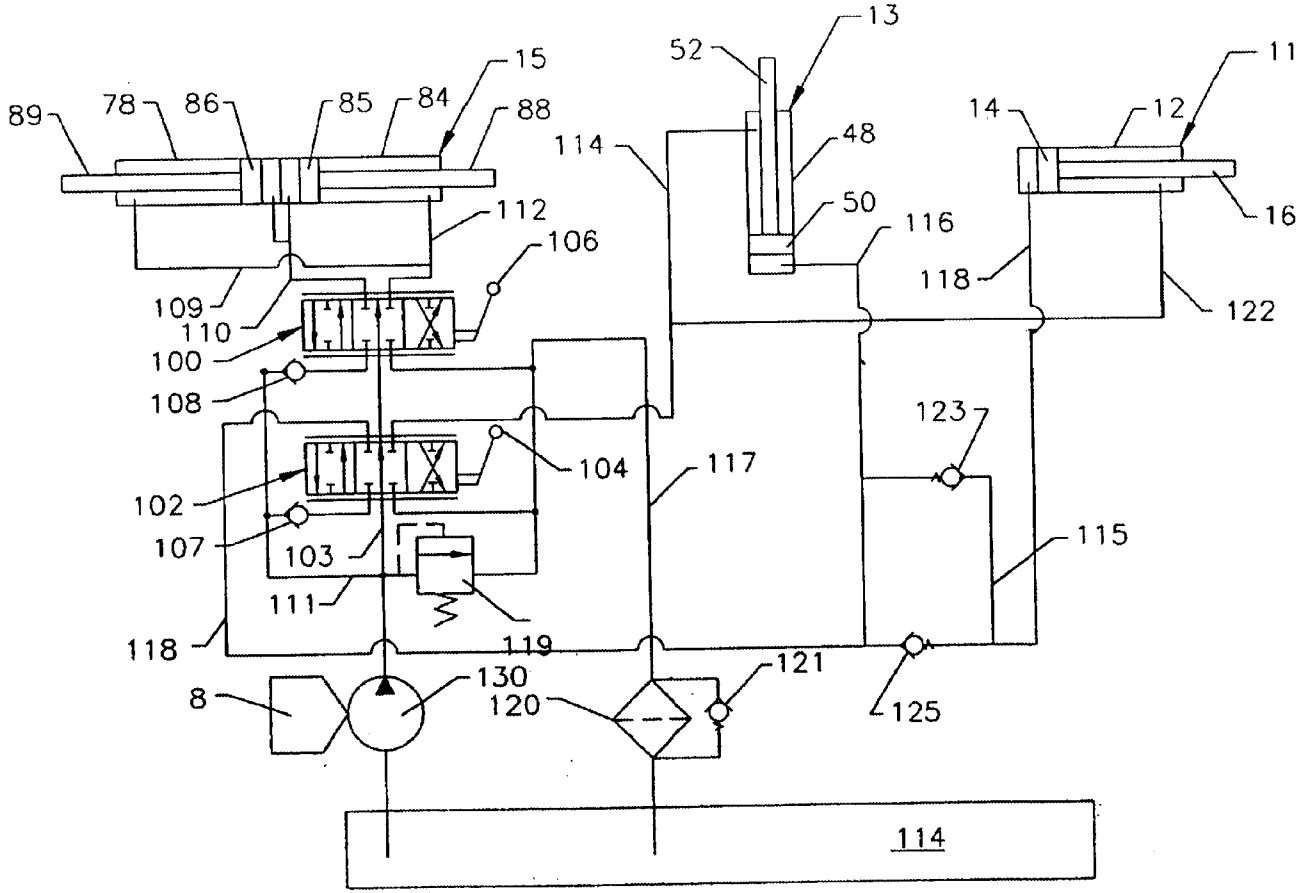
FIG. 12 is a schematic view of the hydraulic system of the present invention.
Figure 14:
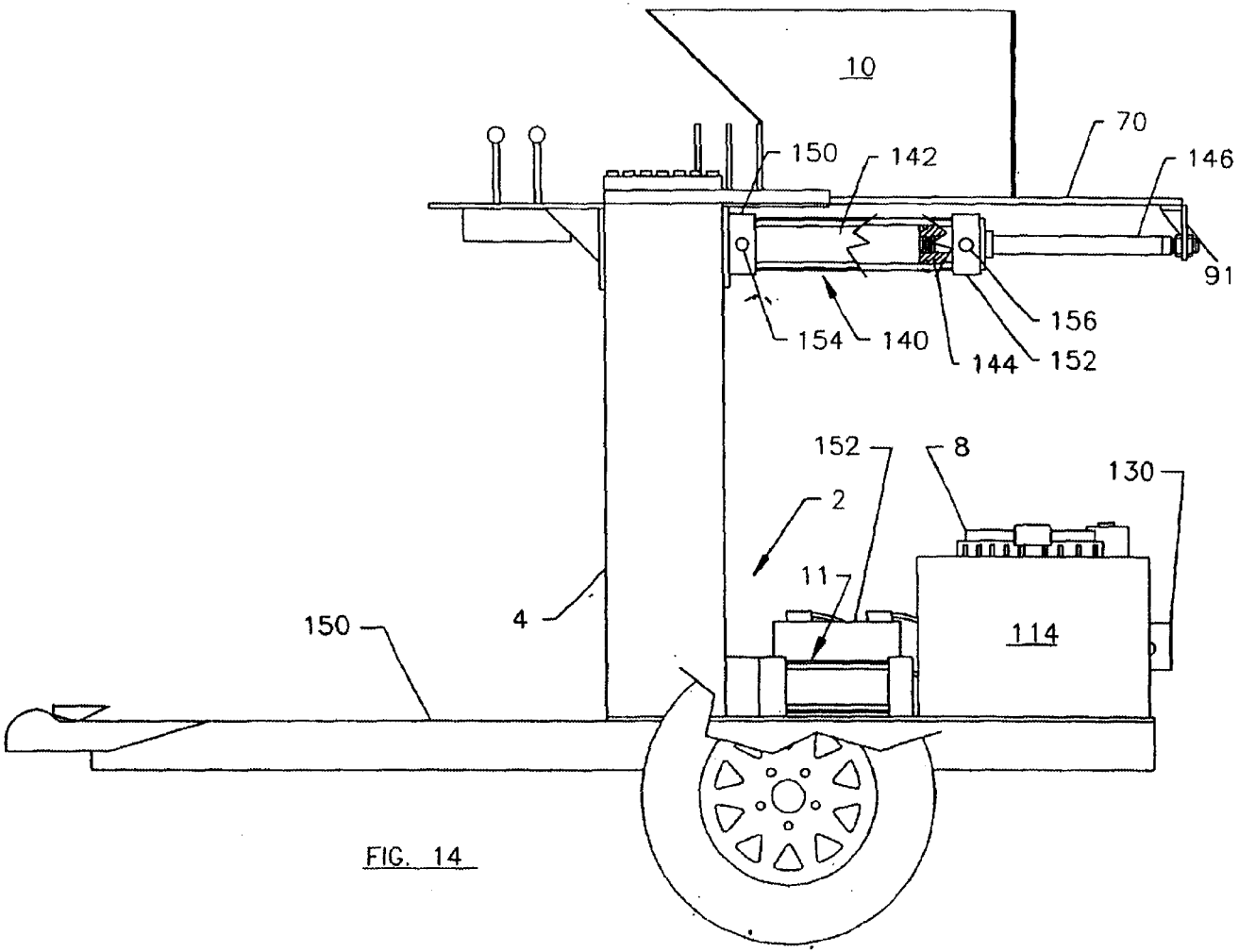
FIG. 14 is a side elevational view, partially broken away, of another embodiment of the present invention which utilizes a single cylinder and piston for reciprocating movement of the hopper utilized in the machine. The machine is shown mounted on a trailer.

As seen in FIG. 1 an apparatus 2 is provided for forming blocks from compactible materials. The apparatus includes a Machine 4, which may be mounted on a support 6, such as a pallet and the support 6 further supports (as seen in FIG. 1) an electric generator 8 which provides electrical power to a hydraulic pump 130 which directs hydraulic fluids to and from a plurality of fluid actuators 11, 13, and 15 as described hereinbelow. The pump 130 is shown in FIGS. 12 and 14.

Fluid actuator 15 provides for horizontal movement of a hopper 10 to direct the material into a cavity 14 (FIG. 4) of a housing 19 which forms the upper portion of the machine and in which the blocks are formed on a movable platform which is moved into and out of registry with cavity 14 by a piston rod 88 of actuator 15.

Actuator 13 is the ram cylinder which includes a piston 50 and piston rod 52 which has a pressure plate 61 mounted at its distal end and which serves as the "floor plate" of cavity 14 and is movable into cavity 14 to compress the ompactible materials therein, as will be discussed hereinbelow.

Actuator 11 (hereinafter referred to as the "supercharger" actuator) is provided in communication with actuator 13 for cooperation with actuator 13 to increase the output pressure thereof to provide for extremely high pressures of compaction of the material in cavity 14. Cavity 14 is typically in the form of a rectangle, although other configurations such as octagonal, hexagonal, etc. may be utilized to form the shape of the blocks formed in the cavity.

Figure 4:
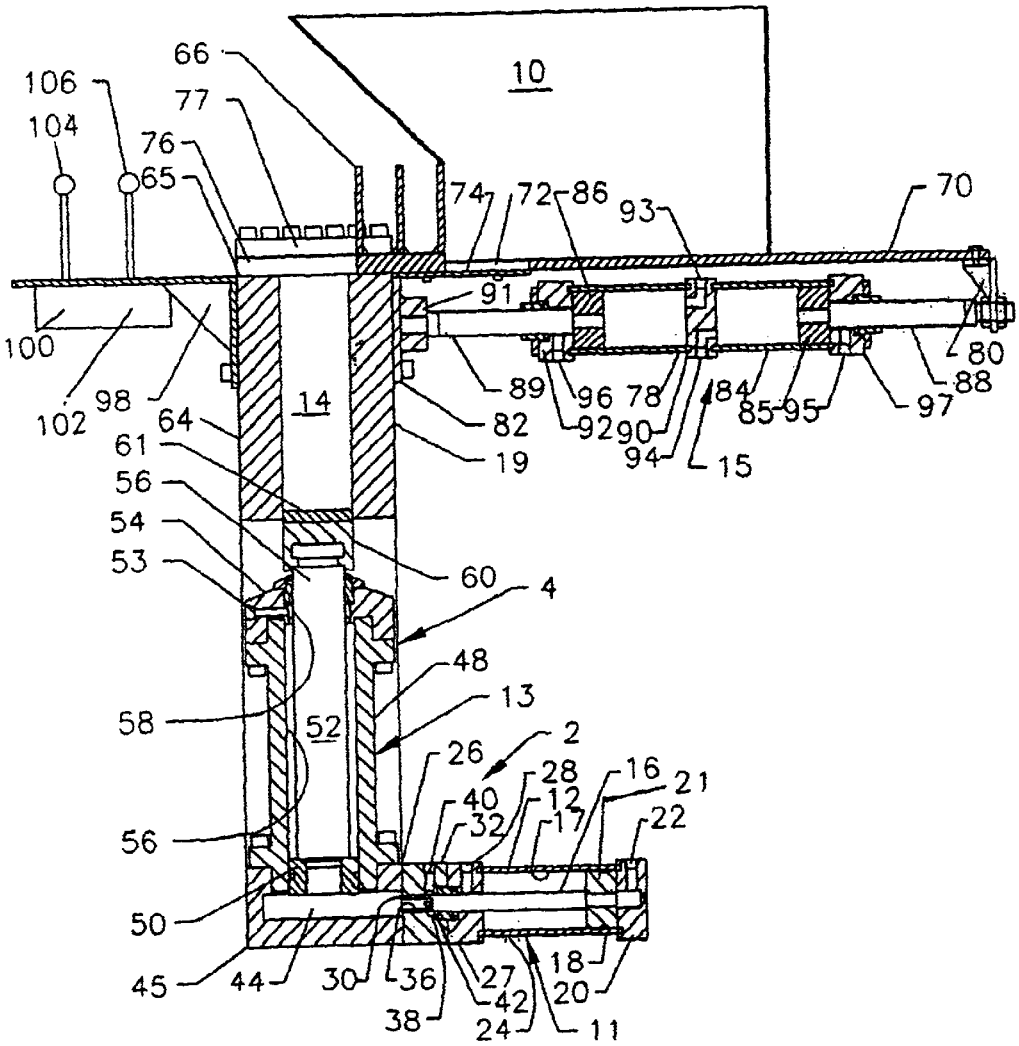
FIG. 4 is a sectional view of the machine illustrated in FIG. 1 and illustrates all cylinders to be in "home position" (non-actuated position).
Figure 4A:
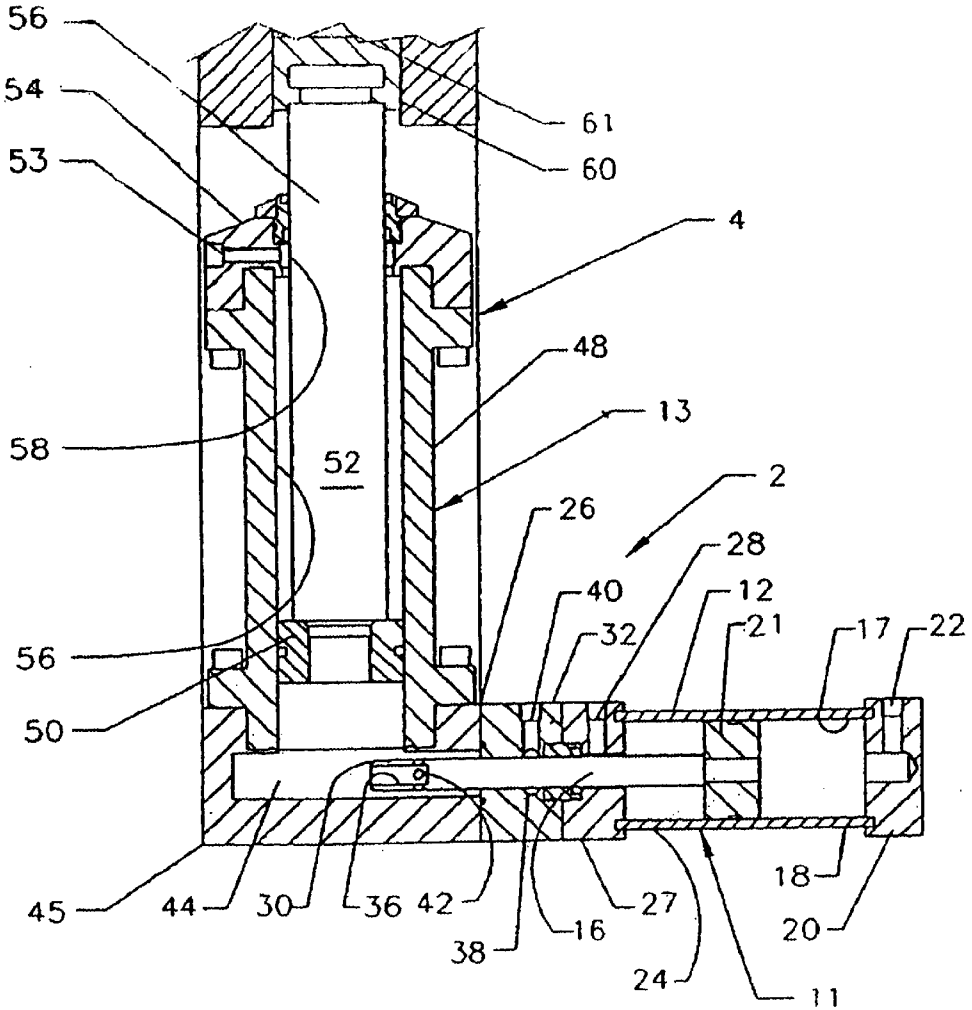
FIG. 4*a* is a sectional view showing the pressure increasing assembly of assembly of FIG. 4.

Actuator 11 is shown in FIGS. 4 and 4*a* to include a first cylinder 12 enclosing a piston 21 and piston rod 16, which is mounted in a bore 17 of cylinder 12. Cylinder 12 is provided at one end 18 with, an end closure member 20 having a fluid passage 22 therein. At the second end 24 of cylinder 12 is an end closure assembly 26 including a rod supporting member 27 having a fluid passage 28 therein. Fluid passages 22 and 28 communicate into bore 17 on opposite sides of piston 21.

Piston rod 16 includes an end portion 30 which extends out of cylinder 12 and into end closure assembly 26. A piston rod support member 32 is provided in closure assembly 26 for support of end portion 30 of piston rod 16. An axial bore 36 is provided in the end portion 30 of piston rod 16 and an annual passage 38 extends around rod support member 32. A fluid passage 40 in rod support member 32 communicates into annular passage 38. A plurality of radially extending ports 42 is provided in the peripheral surface of end port 30 of piston rod 16 and communicates into bore 36 of rod 16. Piston rod 16 is reciprocally carried in cylinder 12 and moves the radially extending ports 42 into and out of registry with annular passage 38 and fluid passage 40, for reasons explained hereinbelow.

A bore 44 is provided in a member 45 of end closure assembly 26 which is common to cylinder 12 and a second cylinder 48. The first and second actuators 11 and 13 are shown to be substantially perpendicular to each other but may be parallel with each other or in any other angular positions. A piston 50 and piston rod 52 is reciprocally mounted in cylinder 48 of actuator 13. A fluid passage 53 is provided in an end closure member 54 of cylinder 48 in communication with the bore 56 of cylinder 48 through an annular passage 58 provided in an inner surface of end cap 54.

FIG. 4*a* is a partial view of the joined actuators 11 and 13 with the piston 21 and piston rod 16 of cylinder 12 of FIG. 1 displaced as a result of working fluid pressure being received through fluid passage 22 to the face of piston 21. As can be seen in FIG. 4*a*, fluid passages 40 no longer communicate into the radial passages 42 of piston rod 16 and the piston rod extends into bore 44 to displace fluid therein against the face of piston 50 which moves piston rod 52 to extend end 56 out of cylinder 48 under greatly increased pressure.

In operation, fluid at a predetermined working pressure (5200 PSI, for example) is directed into bore 44 of member 45 through fluid passage 40, radial passages 42, and bore 36 of rod 16. Fluid at the same predetermined working pressure is also directed through fluid passage 22 against piston 21 to displace the piston 21 and the piston rod 16. Rod 16 is moved into bore 44 of end cap member 46 as a result of this displacement. The rod displaces the fluid in bore 44 against the face of piston 50 in cylinder 48 to move the piston. 50 and rod 52.

Rod 52 includes a distal end 56 having a ram element 60 mounted thereon and a pressure plate 61 is secured to ram element 60. Plate 61 extends into cavity 14 of housing 19. The ram plate 61 is provided with the same rectangular, hexagonal, etc. configuration as cavity 14. In the embodiment 20 shown, the cavity 14 is rectangular and is formed by four side panels 64 which extend upwardly and terminate at a distal end 65 (FIG. 4). Mounted atop end 65 of housing 19 is a shuttle assembly 66 which is horizontally slidably movable responsive to actuation of actuator 15.

The shuttle assembly includes a base plate 70 having an opening 72. The base plate 70 slides across a support member 74 which is secured to and extends from a side of housing 19. Hopper 10 is mounted to the base plate support 70 and the base plate 70 is secured to actuator 15 for slidable movement of the base plate and hopper responsive to actuation of actuator 15. Hopper 10 is provided with the opening 72 so that the block forming material may enter cavity when base place 70 is moved sufficiently for opening 72 to be in alignment with cavity 14. In this manner, the material in the hopper can be directed into the cavity 14 for compression by upward movement of piston 52 and pressure plate 61.

Figure 2:
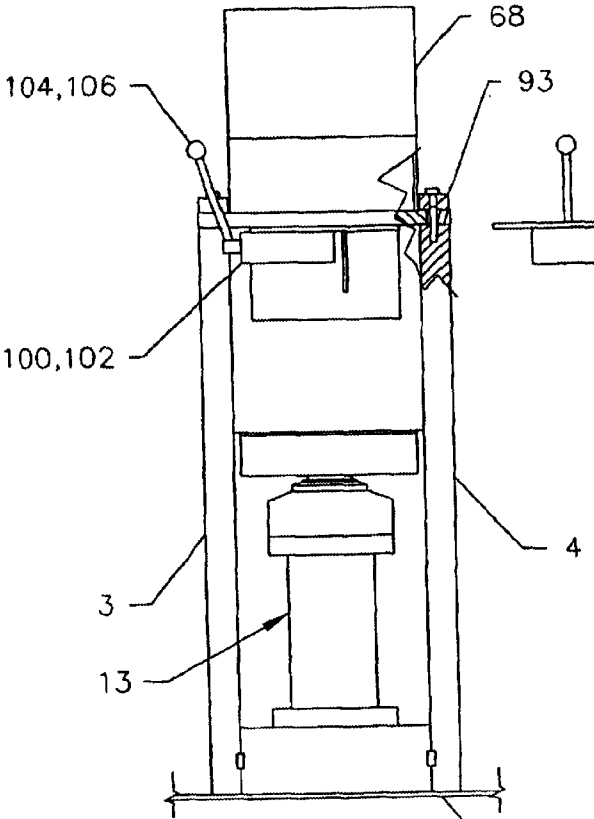
FIG. 2 is an end elevational view partially broken away of the machine of FIG. 1.
Figure 3:
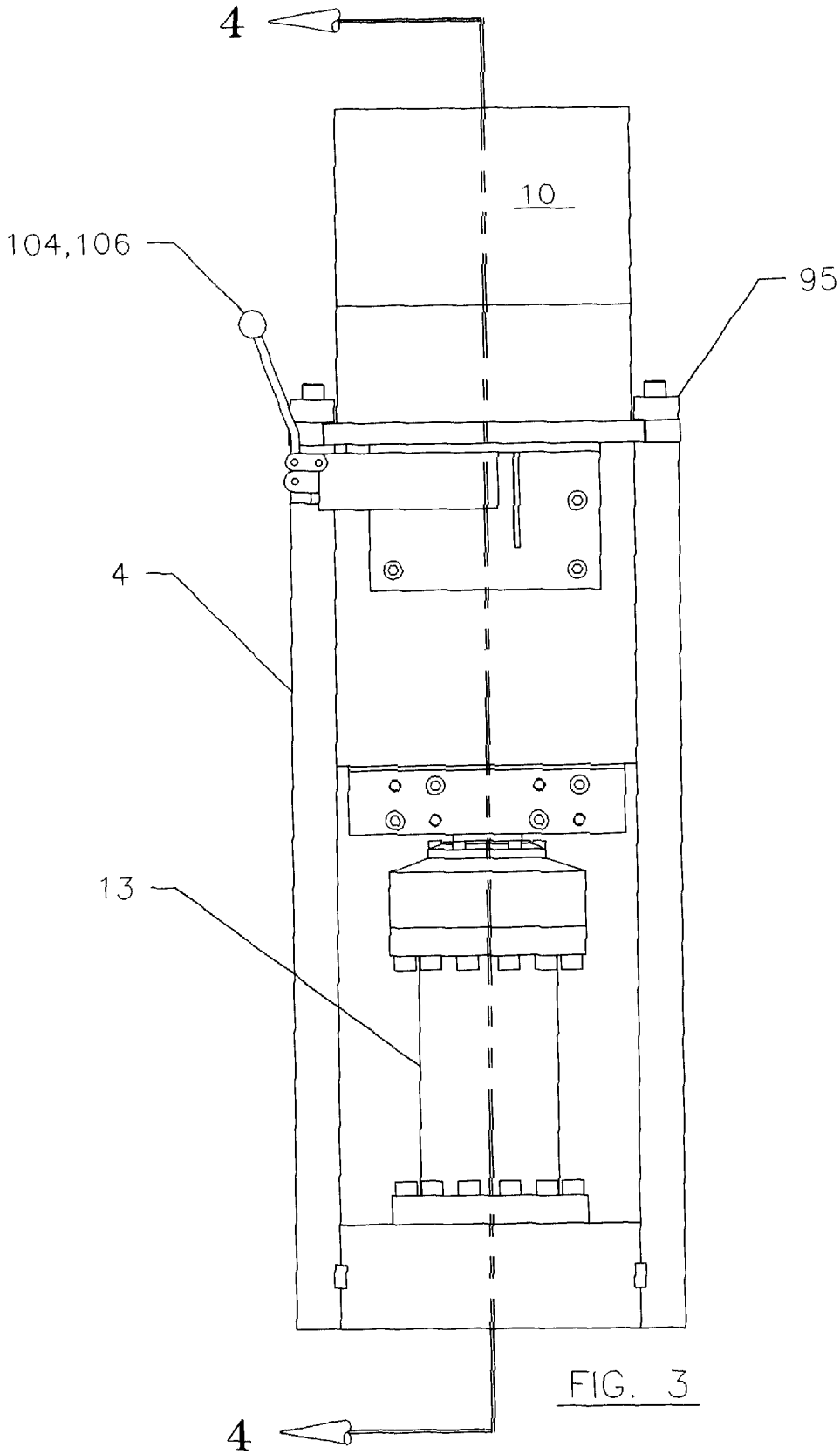
FIG. 3 is an enlarged view of the machine as seen in FIG. 2.
Figure 13:
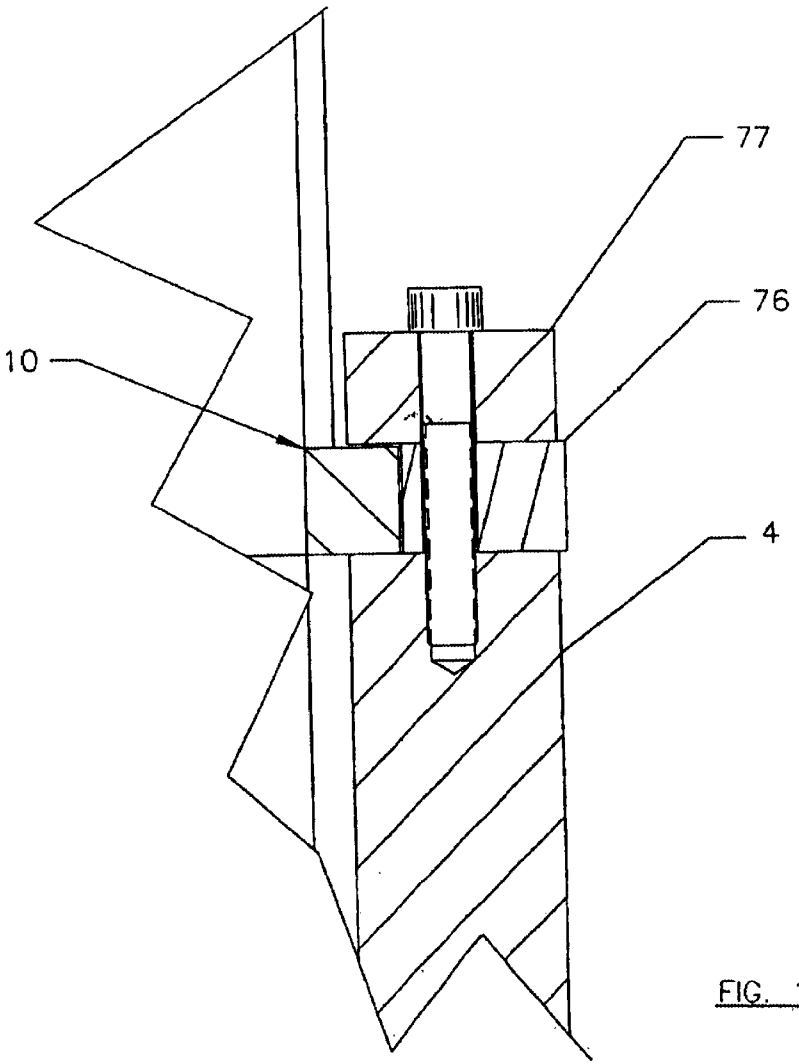
FIG. 13 is a sectional view along section line 13—13 in FIG. 1.

A shuttle tie down assembly (FIGS. 2, 4 and 13) is provided to slidably secure the shuttle assembly to the upper end 65 of housing 19. The tie down assembly includes a plate 77 secured over an extending portion of floor plate 70 and secured to a pair of upstanding stanchions 93 of the machine (FIGS. 2, 3 and 13).

To provide for movement of hopper 10 into and out of registry with cavity 14 of housing 19, fluid actuator 15 includes a pair of double acting pistons 85 and 86 slidably mounted in a pair of cylinders 78 and 84, respectively. An end plate 90 having fluid inlet and outlet ports 93 and 94 sealing secures cylinders 78 and 84 together. An end plate 92 seals the inner end of cylinder 78 and is provided with a fluid inlet/outlet passage 96. A second end plate 97 secures the outer end of cylinder 84 and is provided with a fluid inlet/outlet passage 95. The actuator 15 includes a pair of extending piston rods 88 and 89. Piston rod 89 has its extending end mounted to housing 19 by a support mechanism 91. Rod 88 has its free end secured to a rod link assembly 80 which includes a downwardly extending plate secured to movable base plate 91 support member.

A block shelf assembly 98 is mounted to the side of housing 19 opposite the side that actuator 15 is mounted. The assembly includes an inverted L-shaped plate having one side secured to housing 19 and the other side extending outwardly for support of a pair of valves 100 and 102. Valve 100 controls hydraulic fluid flow to cylinder 15 for control of shuttle assembly movement and valve 102 controls hydraulic fluid flow to actuator 11 and 13 for control of ram movement to force piston 52 up and down in cavity 14. A control lever 104 controls valve 100 and a second control lever 106 controls valve 102.

Figure 5:
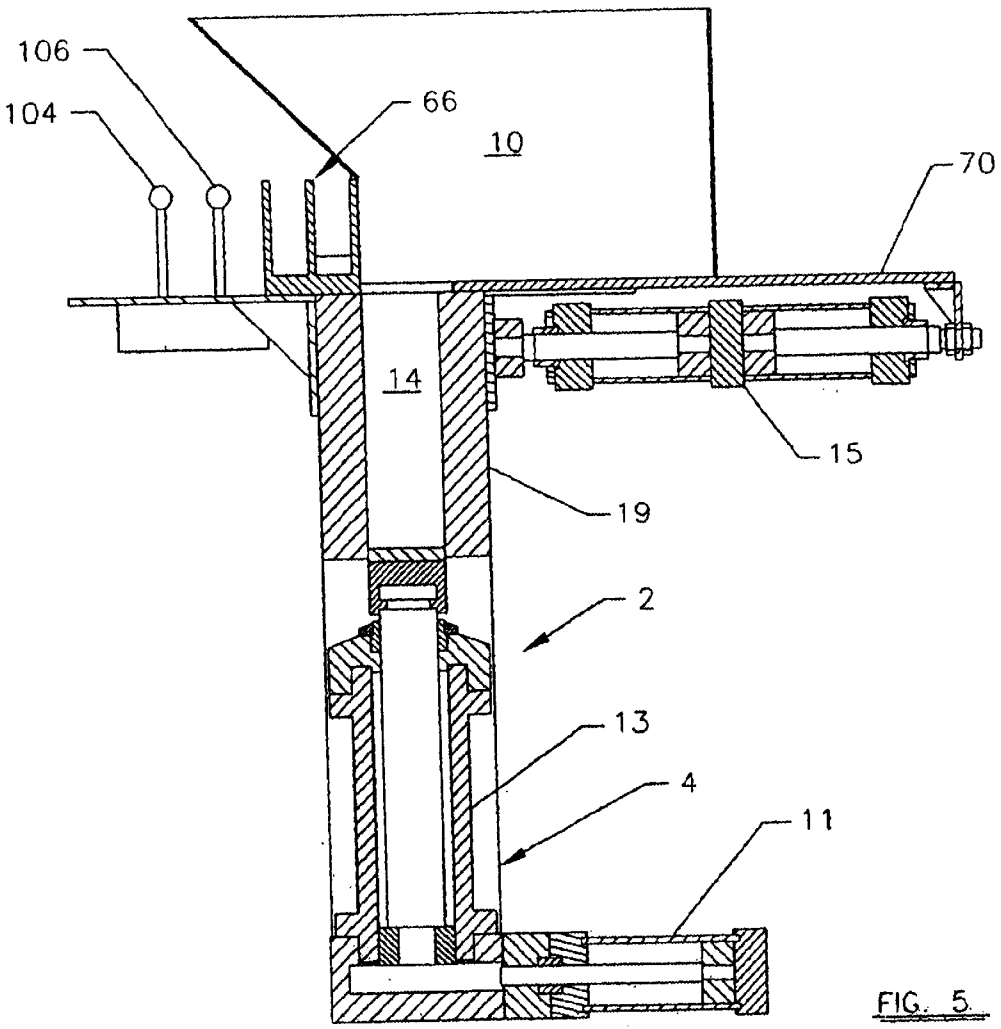
FIG. 5 is a view similar to FIG. 4 with the hopper mounted on a shuttle and moved to a position for dumping the compactible material of the hopper into the block forming cavity of the machine.
Figure 6:
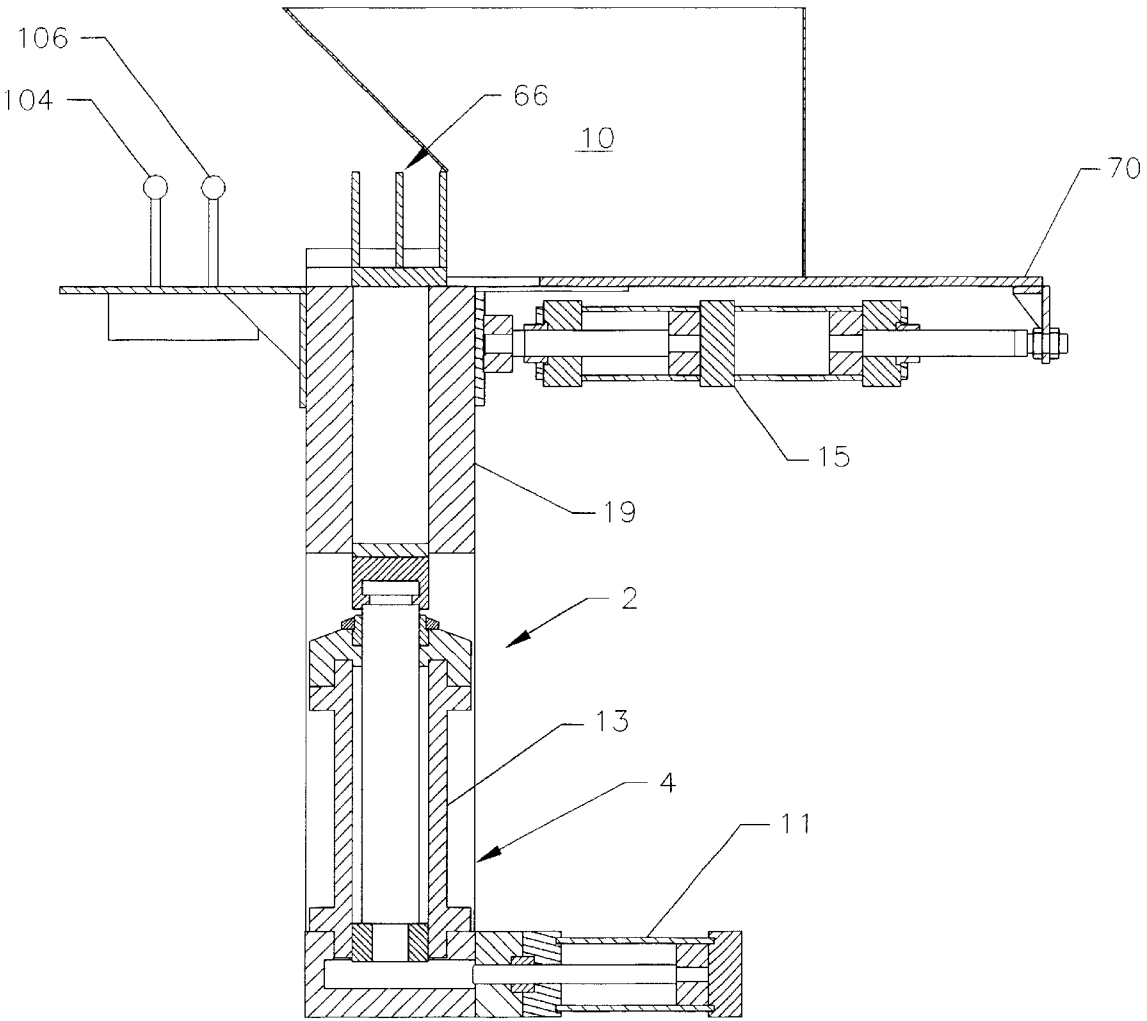
FIG. 6 is a view similar to FIG. 4 with the shuttle retracted halfway so the block forming cavity is covered and the bottom opening of the hopper is out of registry with the block forming cavity of the machine.
Figure 7:
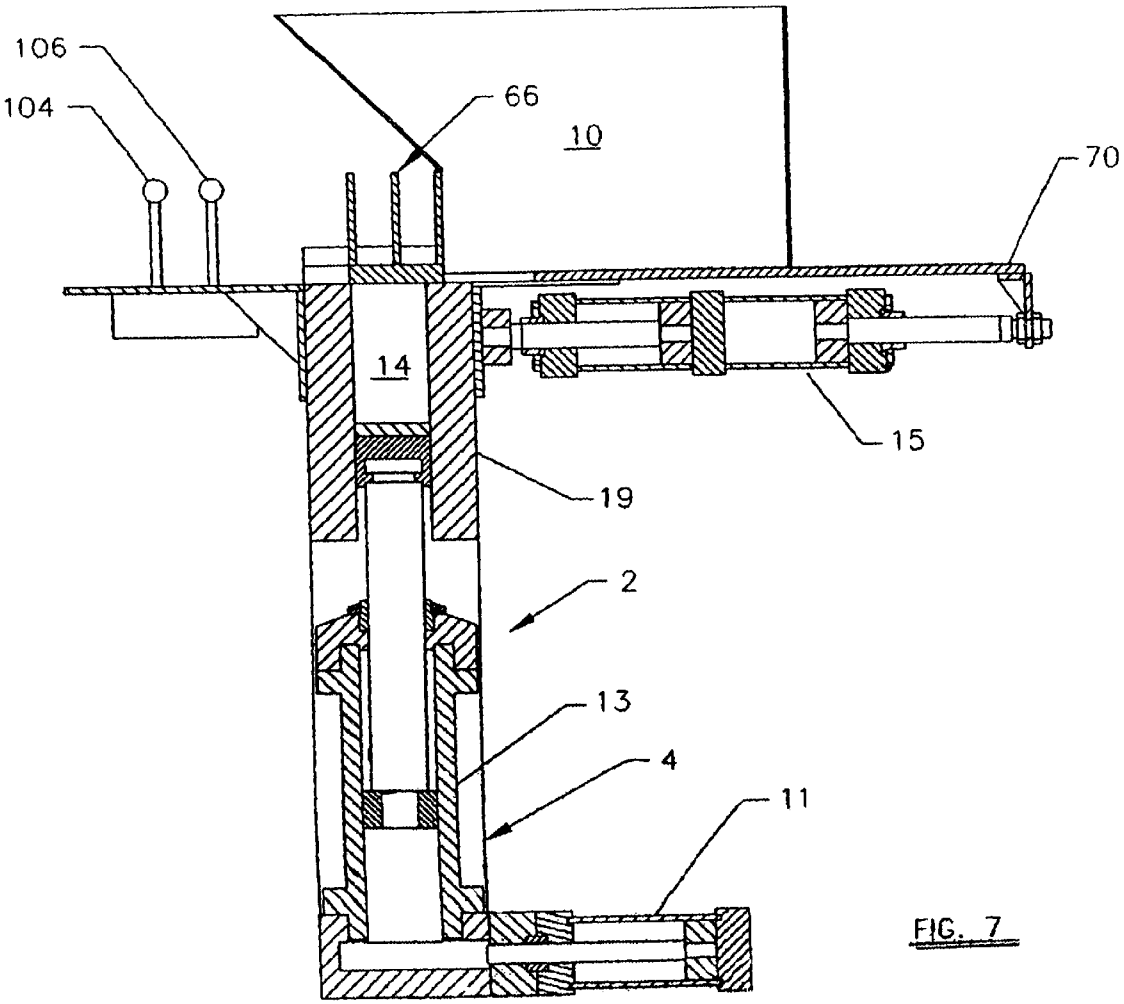
FIG. 7 is a view similar to FIG. 6 with the ram moved upwardly to compact the material in the block forming cavity of the housing.
Figure 8:
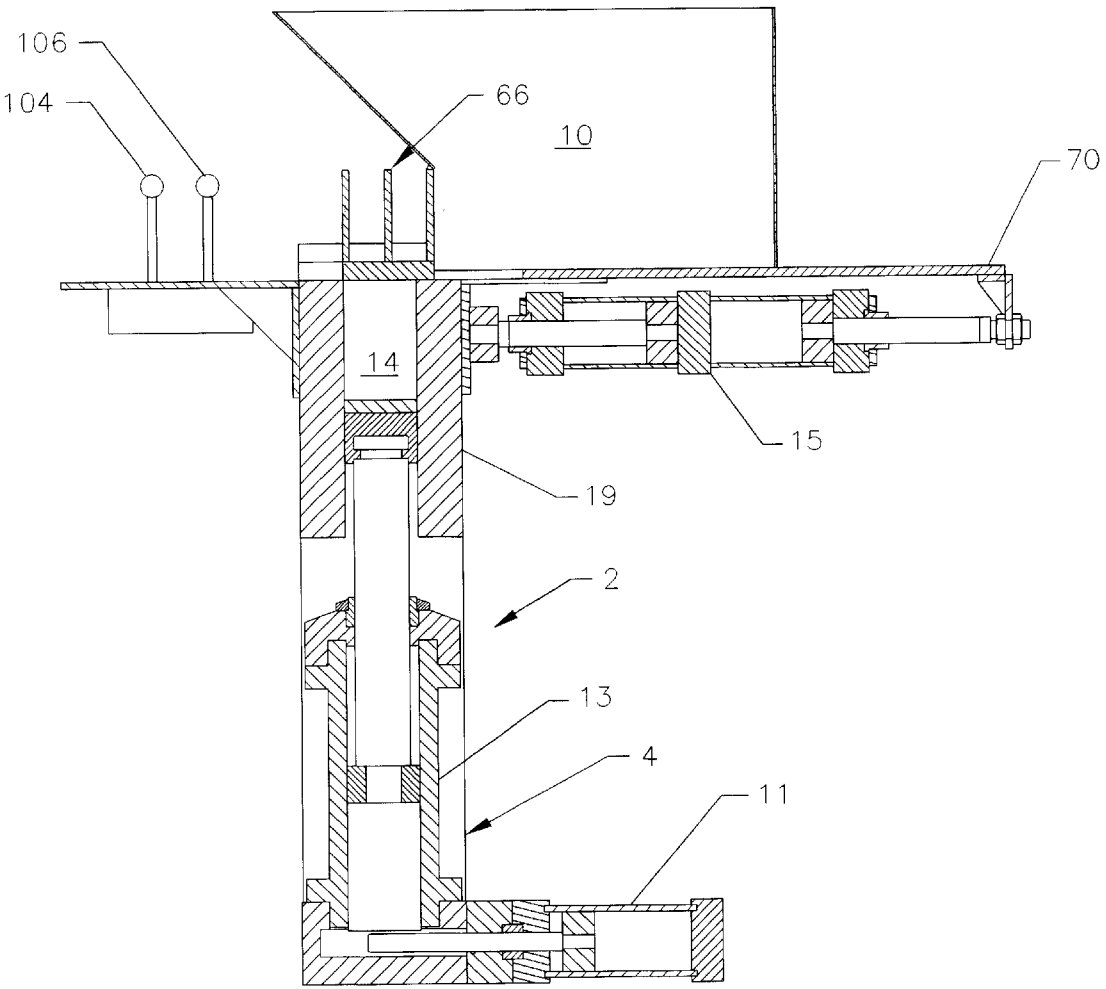
FIG. 8 is a view similar to FIG. 7 and illustrates the piston rod of the super charger actuator moved into the vertical ram cylinder to displace fluid therein and further increase the pressure of the ram cylinder.
Figure 9:
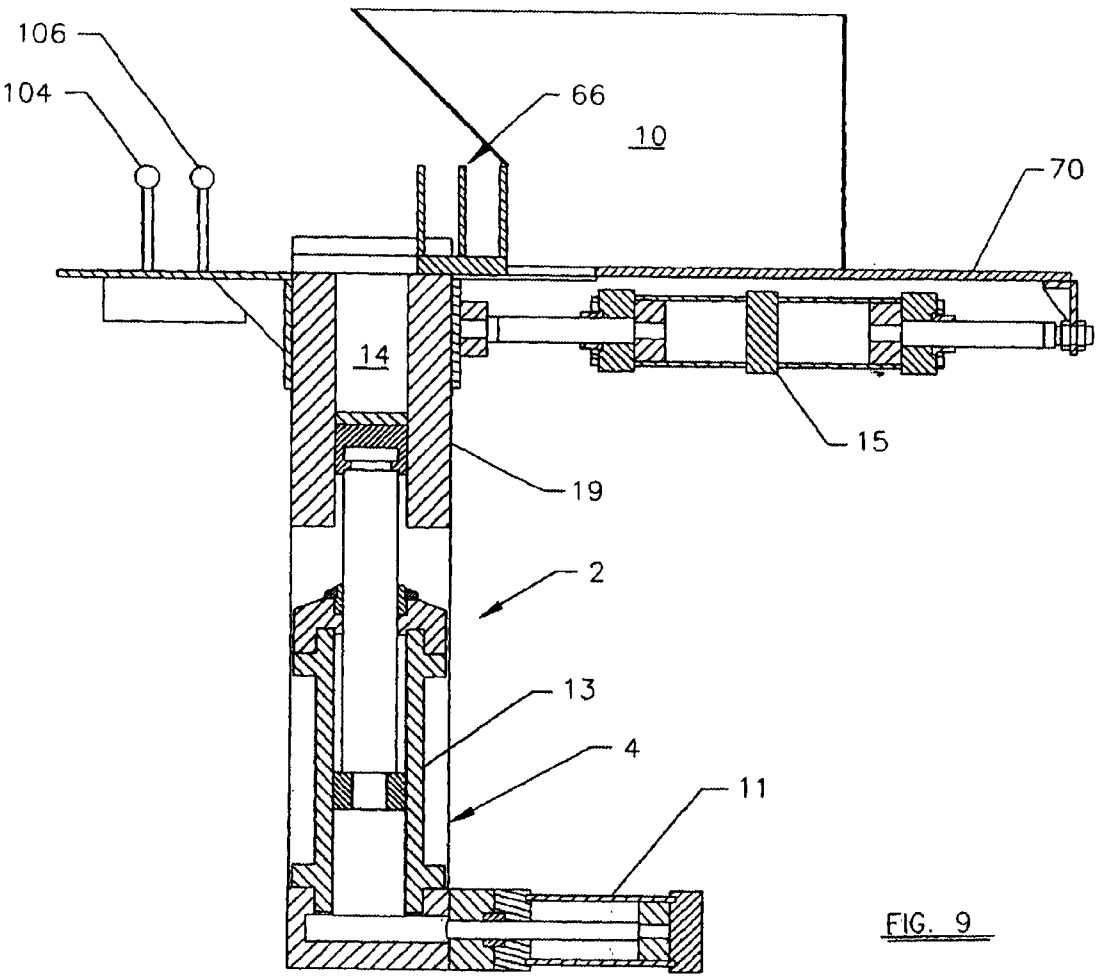
FIG. 9 is a view similar to FIG. 8 but shows the super charged cylinder and shuttle cylinder back to "home position".
Figure 10:
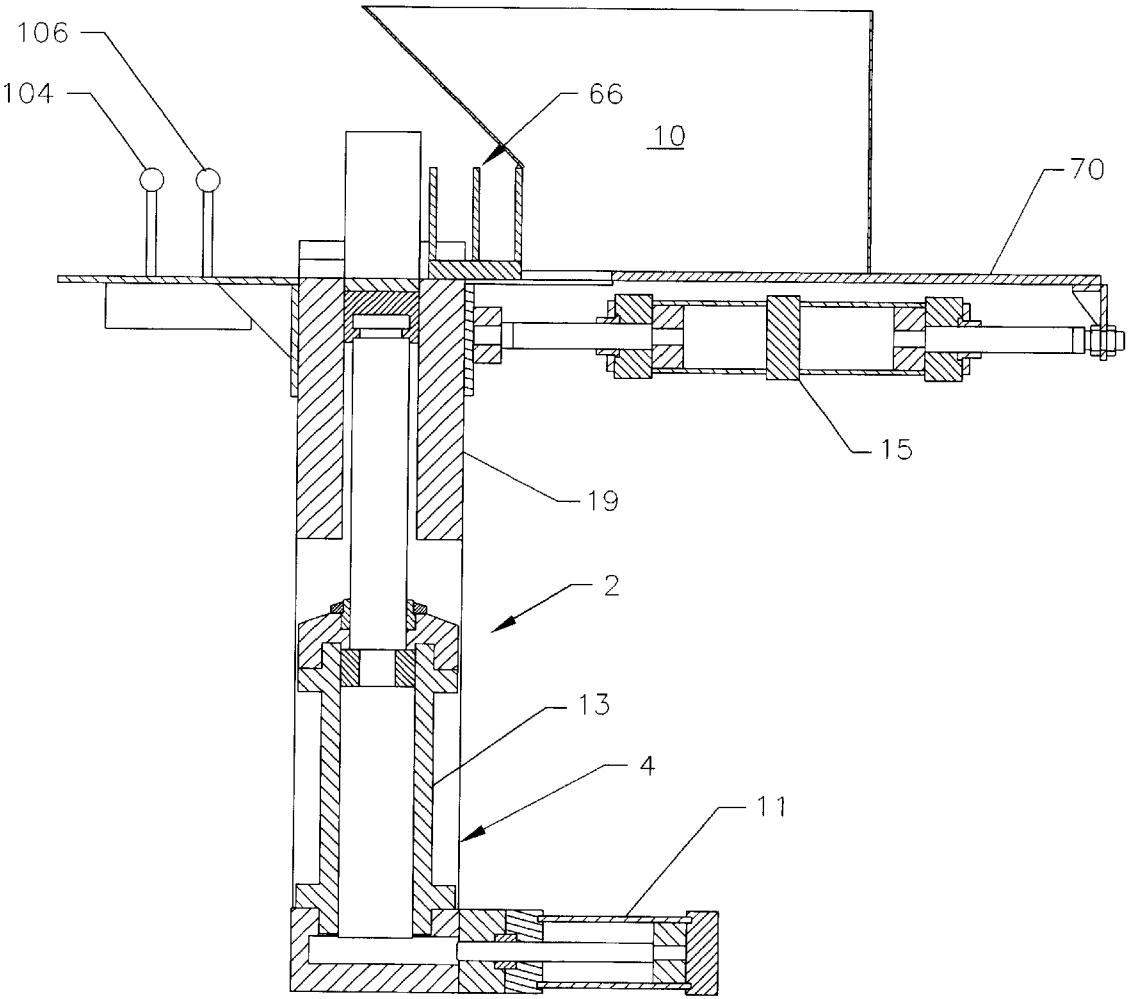
FIG. 10 is a view similar to FIG. 9 but shows the ram up fully to a position for ejecting the block from the block forming cavity of the machine.
Figure 11:
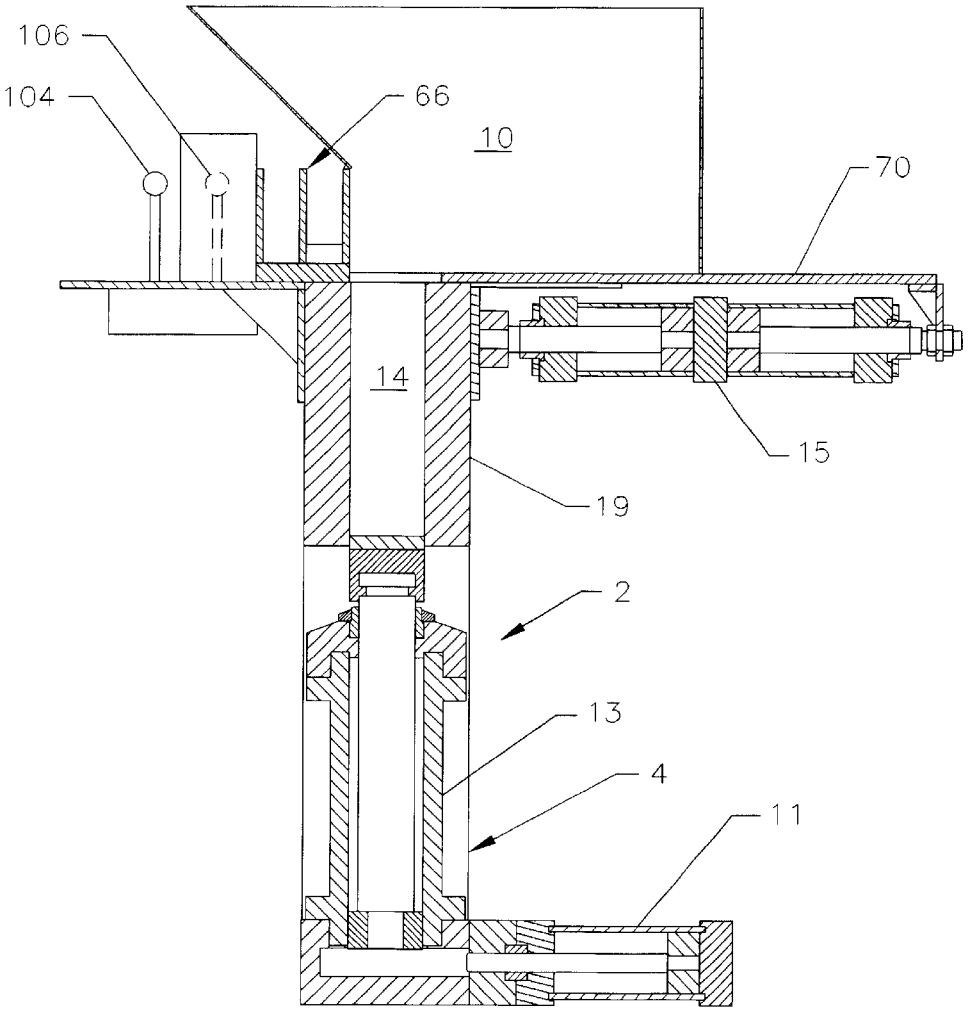
FIG. 11 is a view similar to FIG. 10 but shows the shuttle extended fully outwardly to eject the block.

FIGS. 5–11 are elevational side views of the block forming machine of the present invention illustrating various positions of elements of the machine during operation thereof. FIG. 5 illustrates the hopper 10 moved to a position for dumping the compactible material into the block forming cavity of the machine. FIG. 6 illustrates the hopper halfway retracted and the opening in the bottom of the hopper being covered by cover plate 74. FIG. 7 illustrates the ram moved upward in cavity 14 during the compacting stroke of the ram. FIG. 8 illustrates the piston rod of the supercharger actuator 11 moved into the vertical ram lower housing member 45 of the ram cylinder 13 to increase the fluid pressure against the face of piston 50. FIG. 9 illustrates the supercharger cylinder 11 and the shuttle assembly control actuator 15 back in "home position". FIG. 10 illustrates the ram up fully to the position for ejecting the block from cavity 14. FIG. 11 illustrates the shuttle assembly extended fully to eject the formed block.

FIG. 12 is a schematic view of the hydraulic system of the present invention. As seen in FIG. 12 a pair of hydraulic valves 100 and 102 control fluid flow to cylinder 15 for displacing the hopper. A hydraulic line 110 connects with valve 100 in fluid communication with inlet/outlet passages of pistons 85 and 86 of actuator 15. Lines 109 and 112 connect the valve 100 with inlet/outlet passages 92 and 95 of cylinders 78 and 84.

Valve 102 is fluid connected to ram actuator 13 by hydraulic lines 114 and 116 and to "supercharger" actuator 11 by hydraulic lines 118 and 122.

A pair of check valves 108 and 107 are mounted in a hydraulic line 111 which communicates between valve 100 and 102. Valve 102 includes a pressure adjuster 119, shown separately but which may be included in the valve 102.

A hydraulic pump 130 is connected into valves 100 and 102 through a hydraulic line 103. The pump is shown in FIG. 14 to be physically mounted adjacent generator 8. The pump hydraulically communicates into a tank 114 which is mounted on the support pallet and not shown except in FIG. 12 and in FIG. 14.

A hydraulic line 111 connects between valves 100, 102 and through a filter 120 and into tank 114. A check valve 121 is connected in line 117 between the inlet and outlet of filter 120.

A check valve 125 is provided in line 118 between valve 102 and cylinder 13 which provides for diverting pressure into supercharger cylinder 11 at a predetermined pressure. At a second predetermined (designed) pressure a check valve 123 in line 115 will open, neutralizing cylinders 11 and 13.

Another embodiment of the present invention is illustrated in FIG. 14, wherein like numerals refer to like parts. The machine of FIG. 14 is similar to that described above, except that a single fluid actuator 140 is shown to be mounted to the side of the machine for moving the hopper 10 horizontally in the manner discussed above. Fluid actuator 140 includes a cylinder 142 enclosing a piston 144 and piston rod 146. Piston rod 146 is connected at its free end to plate 91 which is secured to moveable floor plate 70. The cylinder includes end plates 150 and 152 having inlet/outlet ports 154 and 156. The actuator is connected to hydraulic pump 130 as referred to in FIG. 13 and upon actuation of the actuator and resultant displacement of piston 144 and rod 146, floor plate 70 and hopper 10 is horizontally displaced. A trailer 150 is used to transport the apparatus.

It is to be understood that the ratios between the piston and rod diameters of the ram cylinder and cylinder of actuator 11 control the output pressure of the ram as disclosed herein and as substantially disclosed in U.S. Pat. No. 6,012,287 issued to James O. Sims on Jan. 11, 2000.

Assume that piston 21 has a 3.25" diameter which provides a piston area of 8.296 sq. in. Now assume that the piston rod 16 has a 1.375 diameter which provides a rod area of 1.485 sq. in. . Therefore, a 5.587 to 1 ratio exists between piston 21 and rod 16. Now assume that fluid at a 5200 PSI working pressure is directed in cylinder 12 through passage 22 to move the piston 21 and rod 16 to the left as shown in FIG. 2. Piston rod 16 is inserted into bore 44 which has been filled with fluid through passage 40 at 5200 PSI working pressure. Therefore it can be seen that 5200 PSI×5.587=29,052 PSI output pressure being applied against the face of piston 50 of cylinder 48. This increased input pressure against the face of piston 50 also greatly increases the output pressure of piston 50 in accordance with the ratio between the areas of rod 52 and piston 50 in the manner described above in conjunction with piston 21 and rod 16. For example, if the second piston 50 and rod 52 is provided with a 12.566 to 1 ratio then the output force on rod 52 is 12.566×29,052 which yields 365,067 pounds. Now to obtain the output in lbs/ft of a 12"×4" pressure plate 61, we must multiply 4"×3 and 365,067 lbs.×3 to get 1,095,252 lbs/ft In operation, the hopper is loaded with the compactible material and with the generator 8 operating the hydraulic pump 130, control knob 106 is moved to operate valve 110 to deliver hydraulic fluid from the pump to actuator 15 for movement of piston rods 88 and 89 (or rod 146 as shown in FIG. 14) to move platform 70 and hopper 10 over block forming cavity 14 to direct the compactible material therein. Control knob 106 is then moved back to reverse the direction of the actuator 15 to withdraw the hopper.

Control knob 104 is then moved to operate valve 102 to deliver hydraulic fluid from the pump to actuators 11 and 13 to operate actuators 11 and 13 as discussed, supra.

It is to be understood that although earth materials (including sludge) has been discussed as a compactible material, other materials (even man-made materials) may be used.

While the invention as been shown and described with respect to a particular embodiment thereof, this is for the purpose of illustration rather than limitation, and other variations and modifications of the specific embodiment herein shown and described will be apparent to those skilled in the art within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A machine for making blocks from compactible material comprising:

a block forming mold;

a first hydraulic actuator including a first cylinder having a first piston, a first piston rod and a ram head disposed therein for movement of the ram head between a retracted position in which the head is removed from the mold and compactible material can fall into the mold, and an advanced position in which the head is moved into the mold and the compactible material therein is compressed to form a block;

a second hydraulic actuator including a second cylinder having a second piston and a second piston rod mounted therein, said second piston rod having a proximal end connected to said second piston and a distal end having defined therein an axial bore and a plurality of radially extending bores communicating into said axial bore; and end closure means including an assembly common to said first and second cylinders and disposed for selectively sealing one end of each said cylinder, said assembly having a member for support of said distal end of said second piston rod and including means responsive to alignment for directing pressurized hydraulic fluid through said bores of said second piston rod and into said first cylinder, whereby fluid pressure against said first piston is increased, resulting in increased output pressure of said ram head against block forming material to substantially bond the particles of said material.

2. A machine as in claim 1 including hopper means having a bottom opening therein, and hopper means disposed for storing said block forming material and for reciprocal movement of said opening in and out of registry with said block forming mold whereby when said hopper means is in registry with said block forming mold, said material falls into said mold.

3. A machine as in claim 2 including means for reciprocally moving said hopper means.

4. A machine as in claim 3 including means for ejecting the formed block responsive to formation thereof.

5. A machine as in claim 4 including first control means for controlling operation of said first and second hydraulic actuators.

6. A machine as in claim 5 including means for controlling reciprocating operation of said hopper means.

7. A machine as in claim 6 wherein said block forming mold is mounted atop said ram cylinder.

8. A machine as in claim 7 wherein said ram head is provided with a plate mounted thereon, said plate defining a vertically movable floor of said block forming mold.

9. A machine as in claim 8 means for reciprocal movement of said hopper means is a third hydraulic actuator mounted to said machine adjacent to and extending in normal relation to said block forming mold.

10. A machine for making blocks from compactible material comprising:

a first hydraulic actuator including a first cylinder having a piston and piston rod reciprocally mounted therein, said cylinder having an upper end and a lower end through which said rod extends;

a pressure plate mounted on the distal end of said piston rod;

an open-ended block forming mold having upper and lower surfaces with said lower surface mounted on said upper end of said first cylinder, said pressure plate forming a vertically movable floor of said block forming mold;

a second fluid actuator including a second cylinder having a first axial bore and a piston and piston rod reciprocally mounted therein, said piston rod of said second fluid actuator having a first end secured to said piston thereof and a second distal end provided with an axial bore therein and a plurality of radially extending bores communicating into said axial bore of said end, said second cylinder having first and second inlet and outlet fluid passages communicating into said first axial bore for directing fluid into and out of said first axial bore;

said first cylinder of said first fluid actuator being provided with a second axial bore and third and fourth inlets and outlets for directing fluid in and out of said first axial bore of said first cylinder, wherein said first and second cylinders are substantially perpendicular to each other;

end closure means including an assembly common to said first and second cylinders and disposed for sealing one end of each said cylinder, said end closure means including a member for support of said distal end of said piston rod of said second cylinder, said member having a third fluid passage for directing fluid into said second axial bore responsive to alignment of said third fluid passage with said axial bores of said first piston, said end closure member having an axial bore therein to receive fluid from said third fluid passage for displacement of said piston of said first cylinder;

a third fluid actuator including a third cylinder having at least one piston and piston rod reciprocally mounted therein, said piston rod extending out of at least one end of cylinder;

a shuttle assembly mounted on said machine atop said block forming mold, said shuttle assembly including a slidable platform having an opening therein, said slidable platform being secured to the distal end of a said extending end of said piston rod of said third fluid actuator for slidable movement responsive to actuation of said third actuator; and a hopper mounted on said slidable platform for movement therewith, said hopper having a bottom opening for registry with said opening in said platform and said block forming mold subsequent to movement of said slidable platform.

11. A block forming machine as in claim 10 including a plate secured to and extending from said machine adjacent said block forming mold, said plate disposed beneath said opening in said platform and said opening in said hopper to retain said compactible material in said hopper.

* * * * *